United States Patent [19]

Apellaniz

[11] 4,031,913

[45] June 28, 1977

[54] FROTH FORMATION LIMITER FOR DRAWINGS-OFF DEVICE OF CARBON DIOXIDE CONTAINING BEVERAGES

[75] Inventor: Ramon Apellaniz, Lasne-Chapelle-Saint-Lambert, Belgium

[73] Assignee: Euracom S.A., Brussels, Belgium

[22] Filed: June 3, 1975

[21] Appl. No.: 583,459

[30] Foreign Application Priority Data

June 5, 1974 Belgium ..... 253663
May 29, 1975 Belgium ..... 254366

[52] U.S. Cl. ..... 137/170.1; 251/122; 138/44

[51] Int. Cl.[2] ..... B67D 1/12

[58] Field of Search ..... 137/170.1; 251/122; 138/44, 40

[56] References Cited

UNITED STATES PATENTS

| | | | |
|---|---|---|---|
| 1,195,958 | 8/1916 | Ash | 251/122 X |
| 2,035,202 | 3/1936 | Smith | 251/122 X |
| 3,013,767 | 12/1961 | De Haven | 251/122 |
| 3,291,441 | 12/1966 | Hansen | 137/170.1 X |

*Primary Examiner*—Alan Cohan
*Attorney, Agent, or Firm*—Bacon & Thomas

[57] ABSTRACT

The subject of the invention is a froth formation limiter for drawing-off devices of carbon dioxide containing beverages, of the type made up of a restrictor centered in a part of the flow circuit so as to offer to the discharged liquid a passage of annular cross-section, the area of which varies along said restrictor, characterized by the fact that the area of aforesaid annular cross-section has a minimum value at the location of the upstream end of aforesaid restrictor, with respect to the direction of flow of the liquid.

9 Claims, 4 Drawing Figures

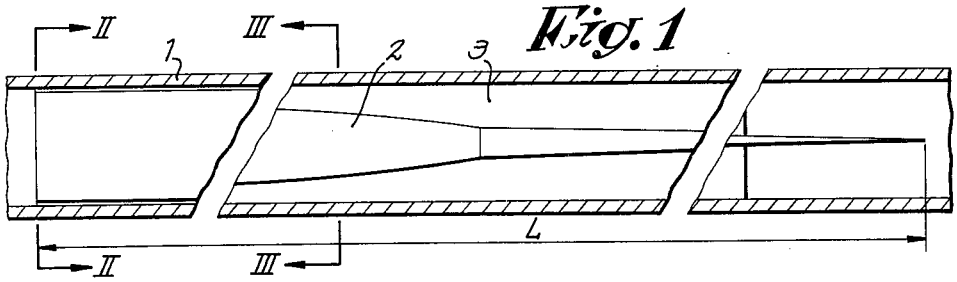
Fig. 1
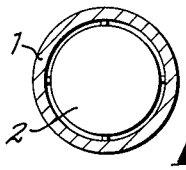
Fig. 2
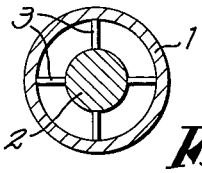
Fig. 3
Fig. 4
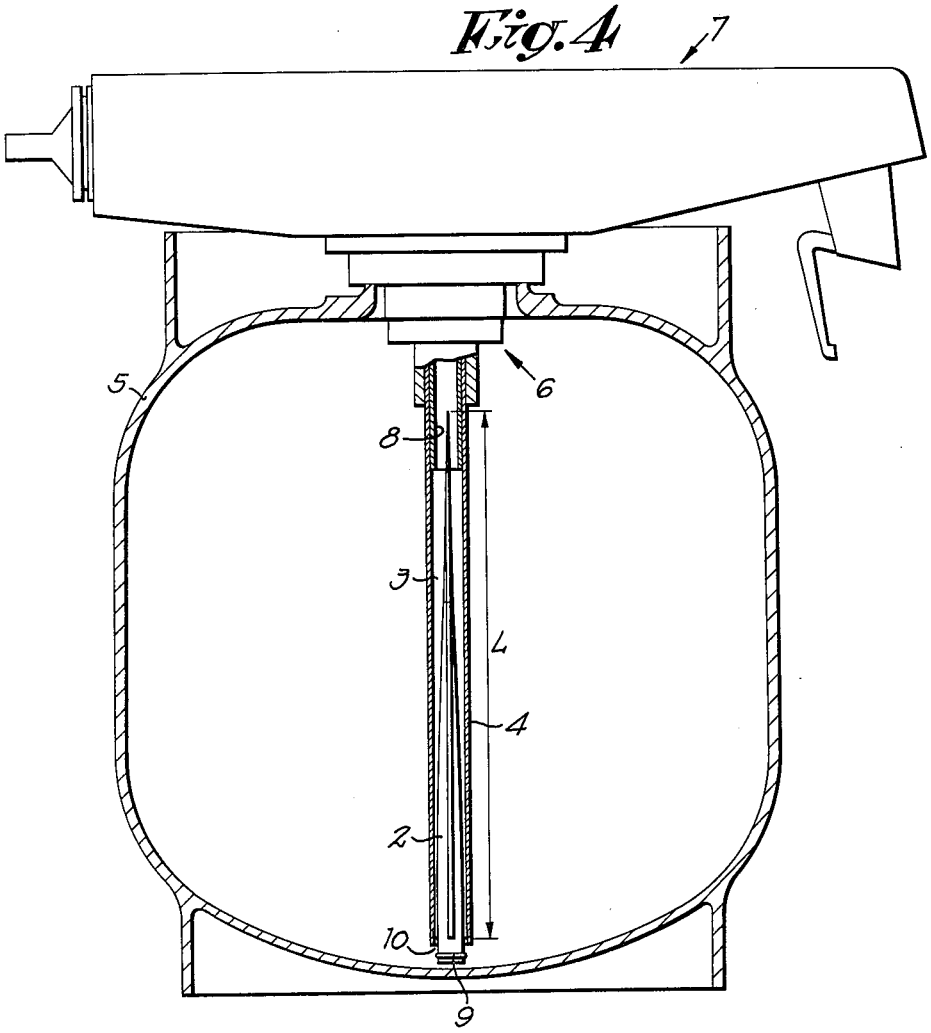

FROTH FORMATION LIMITER FOR DRAWINGS-OFF DEVICE OF CARBON DIOXIDE CONTAINING BEVERAGES

The present invention is concerned with a froth formation limiter for drawing-off devices of carbon dioxide containing beverages.

The sale of beverages with a high content of $CO_2$ raises most particular problems due to the facility with which unacceptable quantities of froth are produced.

In order to limit this inconvenience, various types of restrictors fitted in the discharge pipe have been suggested, some of which consist of one or more balls, and others of a body with pointed or conical shape.

The restrictors of the latter type generally boast an increasing cross-section up to a maximum value, subsequently decreasing in the upstream-downstream sense of the flow of the discharged liquid. A description hereof can be found, for instance, in U.S. Pat. Nos. 2,899,170 and 2,924,238.

It has been found however that the known restrictors were of limited efficiency for the discharge of sweet beverages with a high carbon dioxide content, such as lemonades, cola drinks, etc...

It was indeed discovered, that the known restrictors, under most favourable conditions, became totally ineffective when the temperature of the liquid to be discharged exceeded about 5° C. It is well known that the tendency to froth of carbon dioxide containing liquids increases with temperature. This phenomenon is highly disturbing, because a refrigerating unit is not always available for lowering the temperature of the liquid contained in a cask or barrel below the level of 5° C, at the location where it is wished to sell the beverage.

The applicant has discovered that a highly effective solution was given to the above described problem by using a froth formation limiter of the type consisting of a restrictor centered in a part of the flow circuit in such a manner as to offer to the liquid to be discharged a passage of annular cross-section, the surface of which varies along said restrictor, characterized by the fact that the area of the said annular cross-section has a minimum value at the upstream end of said restrictor, with respect to the direction of flow of the liquid.

According to the invention, aforesaid annular cross-section increases from aforesaid minimum value, in mainly parabolic variation, until it reaches at least 4 times aforesaid minimum cross-section, subsequently to increase mainly according to hyperbolic law up to the discharge cross-section.

At the location of the minimum cross-section, the clearance between the restrictor and the inner wall of the corresponding part of aforesaid circuit should not be larger than 0.5 mm and preferably of the order of 0.1 mm.

Aforesaid part of the flow circuit may be cylindrical and the restrictor shaped, or conversely. In the first case, at least, the hyperbolic increase of the cross-section can be obtained by forming the restrictor in the shape of a cone, the conicity angle of which does not exceed some 10°.

The limiter according to the invention may be provided in any appropriate part of the flow circuit.

In a preferred form of embodiment, it is part of the lower end of the dip tube, as explained later on in greater detail in the description of the invention, with reference to the illustrating and by no means restricting appended drawings, in which:

FIG. 1 is a schematic axial section of a limiter according to the invention;

FIGS. 2 and 3 are cross-sections according to the indications II—II and III—III in FIG. 1; and FIG. 4 is a schematic view of a drawing-off device fitted to a cask or barrel and equipped with a dip tube which comprises the limiter according to the invention.

As shown in FIG. 1, a limiter according to the invention consists of a pipe 1, in the present case cylindrical, and of a restrictor 2 axially fitted in the pipe. In the present case this fitting is held in position by means of longitudinal fins 3 provided for this purpose on the body of the restrictor.

These fins might be replaced by any other appropriate means such as tags, bosses or such like provided for this purpose either on the restrictor or on the wall of the pipe.

At its upstream end with respect to the flow direction on the discharge liquid, restrictor 2 has a cross-section, the area of which is equivalent to approx. 19/20 of the cross-section of pipe 1. In other words, the surface of the annular passage for the liquid is reduced to approximately 6% at the most of aforesaid cross-section.

The diameter of the restrictor decreases from its upstream end towards its downstream end mainly according to parabolic law, and such at least for over one half the total length L of the restrictor. At the end of this mainly parabolic increase, the cross-section for liquid passage is about 7.5 times larger than the minimum cross-section at the upstream end of the restrictor.

Over the remaining part of its length, the restrictor has a conical shape, with an angle of conicity of between 4° and 12°, for instance equal to 10°

The mainly parabolic part of the restrictor can be determined by means of the formula:

$$S = \left[ \frac{a.x + b.x^2}{10.000} + \sqrt[2]{SO} \right]^2$$

in which:

S = throughput cross section at any given point;

$x$ = distance of the considered point to the initial cross-section;

So = the initial cross-section;

$a,b$ = selected coefficients, $a$ being, for example, between 0.4 and 15 and $b$ between 0.30 and 0.70.

Very good results have been obtained with $a = 14$ and $b = 0.63$.

The reason why the restrictor is not entirely of parabolic shape is that this would lead to the downstream end having a shape with a very great curvature radius which is unfavourable due to the likelihood of producing turbulence and/or harmful detachment phenomena.

In the example of practical application schematically shown in FIG. 4, the above-described limiter is part of the lower end of a dip tube 4 fitted to a small barrel or cask 5. Tube 4 is held in its location in the well known manner by a bung 6.

The drawing-off device, generally indicated as 7, is provided with a pipe 8 which is meant to pass through aforesaid bung 6 and to penetrate into aforesaid dip tube 4 when fitting the drawing-off device.

In this form of embodiment, restrictor 2 also serves as shut-off device for the dip tube, as long as the drawing-off device is not fitted. For this purpose, an 'O' ring bushing 9 is entered into a peripheral groove provided for this purpose in the immediate vicinity of the upstream end of restrictor 2. The latter is entered with a frictional fit into the dip tube, until ring 9 enters a counterbore 10 at the lower end of tube 4. The latter is consequently sealed off, as long as the drawing-off device has not been fitted. When fitting this device 7, the end of its pipe 8 comes to rest on the front surfaces of fins 3, subsequently to push back the restrictor towards the position shown in FIG. 4. Dip tube 4 is then accessible for the liquid contained in cask 5.

This arrangement has the advantage of entailing no extra difficulties for the utilizer during the periodic cleaning required by the drawing-off device, cleaning which is necessary, amongst others, due to the high sugar content often occurring in beverages containing a lot of carbon dioxide. We do indeed find that the dip tube and the limiting device are functionally integrated with cask 5 and are consequently cleaned industrially when filling the cask with liquid.

As alternative, the restrictor could be fitted at the downstream end of the discharge pipe and be conditioned as a cone faucet so as to be able to control the discharge flow.

In short, the limiting device according to the invention causes, in the flow of the liquid to be drawn-off, a maximum loss of head at the upstream extremity of the restrictor, followed by a harmonious and gradual reduction of the loss of head down to the required value.

What I claim is:

1. A foam formation limiter for drawing-off devices for containers of pressurized carbonated beverages, comprising:

a cylindrical tubular member having a beverage entrance end and defining a flow path for said beverage; and a foam limiter comprising an elongated member extending centrally within said tubular member and defining with said tubular member and annular flow path for said beverage, said foam limiter being of greatest diameter at said entrance end and tapering to a point in the direction of beverage flow in said tubular member whereby to define, with said tubular member, an annular flow path of increasing sectional area and decreasing boundary surface area, said foam limiter tapering differently in first and second regions of its length said first region tapering convexly and according to a parabolic law and said second region tapering to said point according to a hyperbolic law.

2. Limiter according to claim 1, characterized by the fact that aforesaid mainly parabolic increase corresponds to the formula :

$$S = \left[ \frac{a.x + b.x^2}{10.000} + \sqrt[7]{SO} \right]^7$$

in which :

S = throughput cross-section at any given point;

$x$ = distance of the considered point to the initial cross-section;

So = the initial cross-section;

$a$, $b$ = selected coefficients, respectively comprized between 0.4 and 15 and between 0.30 and 0.70.

3. Limiter according to claim 2, characterized by the fact that $a$ and $b$ are respectively equal to 14 and 0.63.

4. Limiter according to claim 1, characterized by the fact that at the location of the upstream extremity of aforesaid restrictor, the clearance between the latter and the adjacent wall of aforesaid pipe is no greater than 0.5 mm.

5. Limiter according to claim 4, characterized by the fact that aforesaid clearance is equal to 0.1 mm.

6. Limiter according to claim 1, characterized by the fact that the downstream part of the restrictor is conical, with an angle of conicity which does not exceed about 10°.

7. Limiter according to claim 1, characterized by the fact that aforesaid restrictor is provided with a plurality of longitudinal fins or ribs which rest against the inner wall of aforesaid tubular member.

8. Limiter according to claim 1, characterized by the fact that said tubular member is part of a dip tube which in its turn is functionally part of a container of liquid, such as a barrel or cask.

9. Limiter according to claim 8, characterized by the fact that the restrictor is slidable with a frictional fit in the lower end of aforesaid dip tube, the upstream end of the restrictor being fitted with a toric seal ('O' ring) adapted to enter a counterbore of the lower end of the dip tube, so as temporarily to seal off the latter.

* * * * *